US006824501B2

(12) United States Patent
Kuo

(10) Patent No.: US 6,824,501 B2
(45) Date of Patent: Nov. 30, 2004

(54) EXERCISE DEVICE

(75) Inventor: Parkson Kuo, Taipei (TW)

(73) Assignee: VIA Technologies, Inc., Taipei (TW)

( * ) Notice: Subject to any disclaimer, the term of this patent is extended or adjusted under 35 U.S.C. 154(b) by 0 days.

(21) Appl. No.: 10/644,876

(22) Filed: Aug. 21, 2003

(65) Prior Publication Data

US 2004/0038778 A1 Feb. 26, 2004

(30) Foreign Application Priority Data

Aug. 21, 2002 (TW) ..... 91213030 U

(51) Int. Cl.[7] ..... A63B 22/02
(52) U.S. Cl. ..... 482/54; 482/52
(58) Field of Search ..... 482/51–54

(56) References Cited

U.S. PATENT DOCUMENTS 4,555,108 A * 11/1985 Monteiro ..... 482/53
5,145,475 A * 9/1992 Cares ..... 482/52
5,813,947 A * 9/1998 Densmore ..... 482/51
6,348,024 B1 * 2/2002 Hwang ..... 482/52

* cited by examiner

*Primary Examiner*—Stephen R. Crow
*Assistant Examiner*—Tam Nguyen
(74) *Attorney, Agent, or Firm*—Rabin & Berdo, P.C.

(57) ABSTRACT

An exercise device. The exercise device includes a belt type treadmill, a wheel type treadmill, a transmission mechanism, and a panel. The wheel type treadmill is disposed adjacent to the belt type treadmill and includes a plurality of wheels, a plurality of steps coupled to the wheels, and a transmission shaft driving the wheels. The transmission mechanism has a first roller shaft and a second roller shaft, coupled with the transmission shaft. The first and second roller shafts drive the belt type treadmill. The panel is coupled to the belt type treadmill, providing different operation settings for the exercise device. The device provides a more varied exercise experience.

11 Claims, 7 Drawing Sheets

EXERCISE DEVICE

BACKGROUND OF THE INVENTION

1. Field of the Invention

The present invention relates to an exercise device, and in particular to an exercise device provided with belt and wheel treadmill types to provide a wide variety of interactive exercise options.

2. Description of the Related Art

Exercise devices of various types are well known and popular. However, exercise is often repetitive and boring, especially when performed indoors. One widely used exercise device is a treadmill T, comprising a belt 13' driven by roller shafts 15*a*', 15*b*', as shown in FIG. 1. Settings such as speed are input from a panel 100' and a handrail 11' is held while running on the belt 13'. First and second roller shafts 15*a*', 15*b*' either actively drive the belt 13' as the user 10' runs or walks thereon, or, in passive mode, freely rotate, driven by user tread activity producing friction on belt 13'.

Even so, the device provides only a very limited range of exercise experience, and thus, little motivation or interest to the user.

SUMMARY OF THE INVENTION

Thus, an object of the invention is to provide an exercise device, composed of both belt and wheel treadmill types, providing walking, running, and climbing experiences to make exercise routines fresh and motivating.

Another object of the invention is to provide an exercise device, provided with a display or other simulation apparatus, offering the user a simulated environment for both mental and physical interactivity.

The present invention provides an exercise device, including a belt type treadmill, a wheel type treadmill, a transmission mechanism, an operating panel and a display device. The wheel type treadmill is disposed adjacent to the belt type treadmill * and includes two wheels, a plurality of steps coupled to the wheels, and a transmission shaft driving the wheels. The transmission mechanism has a first roller shaft and a second roller shaft, coupled with the transmission shaft. The first and second roller shafts drive the belt type treadmill. The panel is coupled to the belt type treadmill, providing different operation settings. The display device is coupled to the panel, providing environmental simulation.

A detailed description is given in the following embodiments with reference to the accompanying drawings.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

Figure 1:
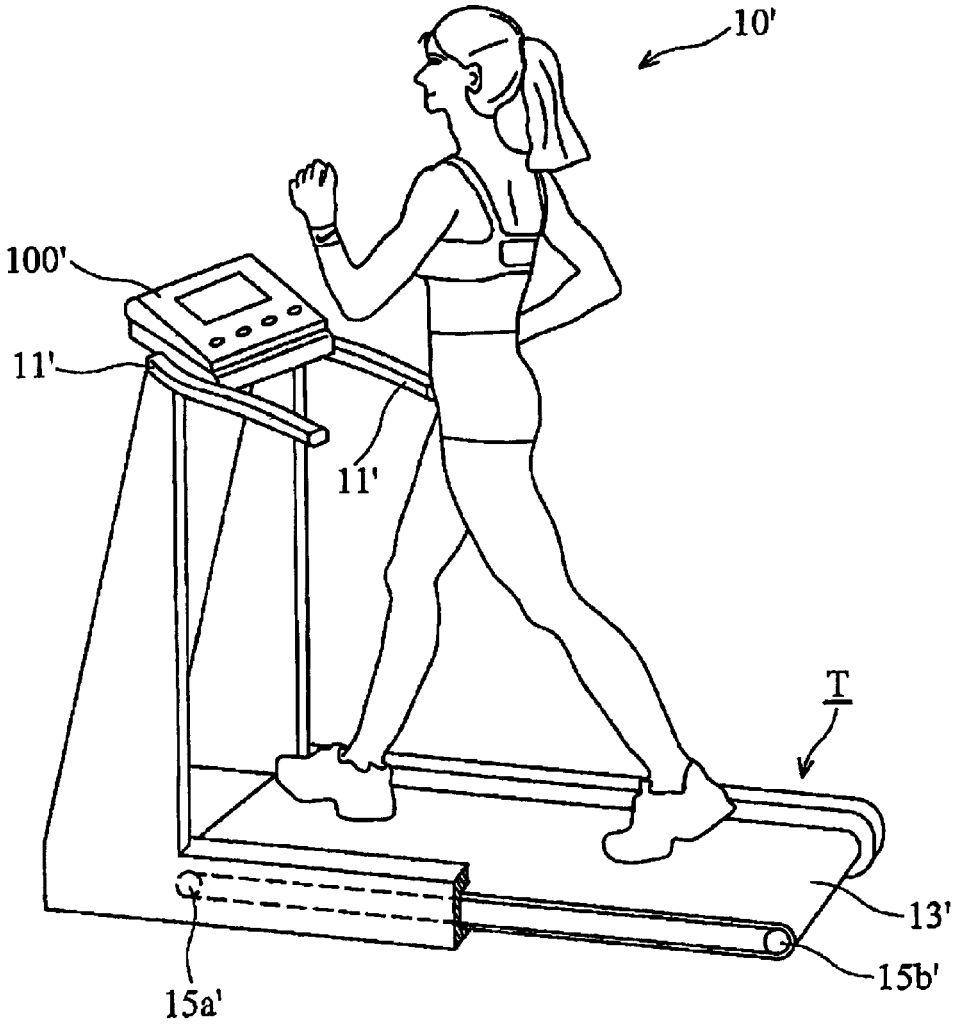
FIG. 1 (PRIOR ART)
FIG. 1 is a schematic view of a conventional treadmill.
Figure 2A:
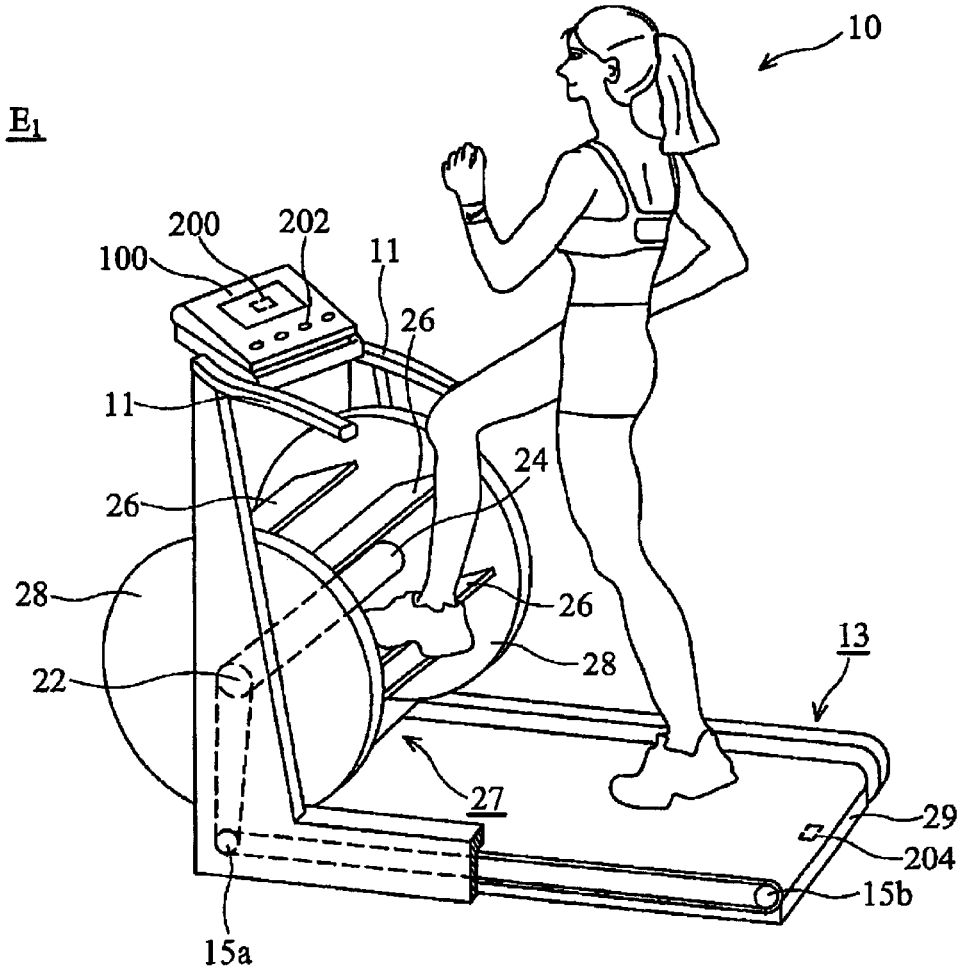
FIG. 2A is a schematic view of an exercise device according to the first embodiment of the present invention.

FIG. 2A is a schematic view of an exercise device according to the first embodiment of the invention. The exercise device $E_1$ of the present invention is a compound treadmill, comprising a belt type treadmill 13 driven by roller shafts 15*a*, 15*b* and a wheel type treadmill 27, as shown in FIG. 2A. Settings such as speed are input from panel 100 and a handrail 11 is held while running on the belt 13. First and second roller shafts 15*a*, 15*b* either actively drive the belt type treadmill 13 as the user 10 runs or walks thereon, or, in passive mode, freely rotate, driven by user tread activity producing friction on belt 13. The difference between FIG. 1 and FIG. 2 is that an additional wheel type treadmill 27 is provided on the belt type treadmill 13. Thus, the belt type 13 and the wheel type treadmill 27 constitute the compound treadmill, providing both running and climbing experiences. The wheel type treadmill 27 includes a plurality of steps 26, disposed between two aligned wheels 28, to provide climbing motion. The climbing motion is driven by transmission shaft 24, disposed in the center of the wheels 28. Moreover, a transmission mechanism 22 disposed in the wheels 28 is simultaneously driven by the transmission shaft 24. The transmission mechanism 22 is coupled with the wheel type treadmill 27 and the first roller shaft 15*a*. The first and second roller shafts 15*a*, 15*b* drive the belt type treadmill 13. A panel 100 is disposed in front of the compound treadmill, providing different operation settings such as speed and active or passive mode selection. In passive mode, the user 10 can run at any desired speed, controlling the speed of the treadmill. In passive mode, a predetermined speed is set, and followed by the user 10.

The steps 26 of the wheel type treadmill are kept in a useable horizontal orientation by built-in counter-weighting. Other means can be implemented to maintain the steps 26 in a horizontal orientation, as is apparent to those skilled in the art, thus, further explanation is not described here.

Figure 2B:
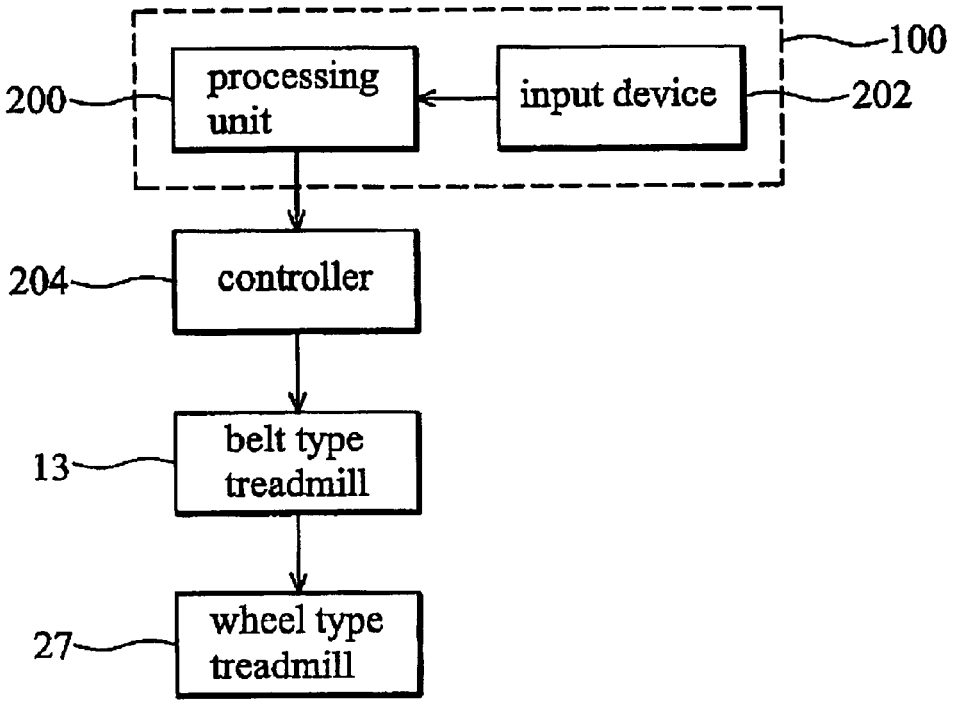
FIG. 2B is a flowchart illustrating the operation of the exercise device.

FIG. 2B is a flowchart illustrating the operation of the exercise device $E_1$. A processing unit 200 and an input device 202 are disposed in the panel 100. When the processing unit 200 receives a command from the input device 202, a signal is then delivered to a controller 204 located at base 29, controlling the belt type treadmill 13. The belt type treadmill 13 is coupled to the wheel type treadmill 27 by the transmission mechanism 22.

Figure 3A:
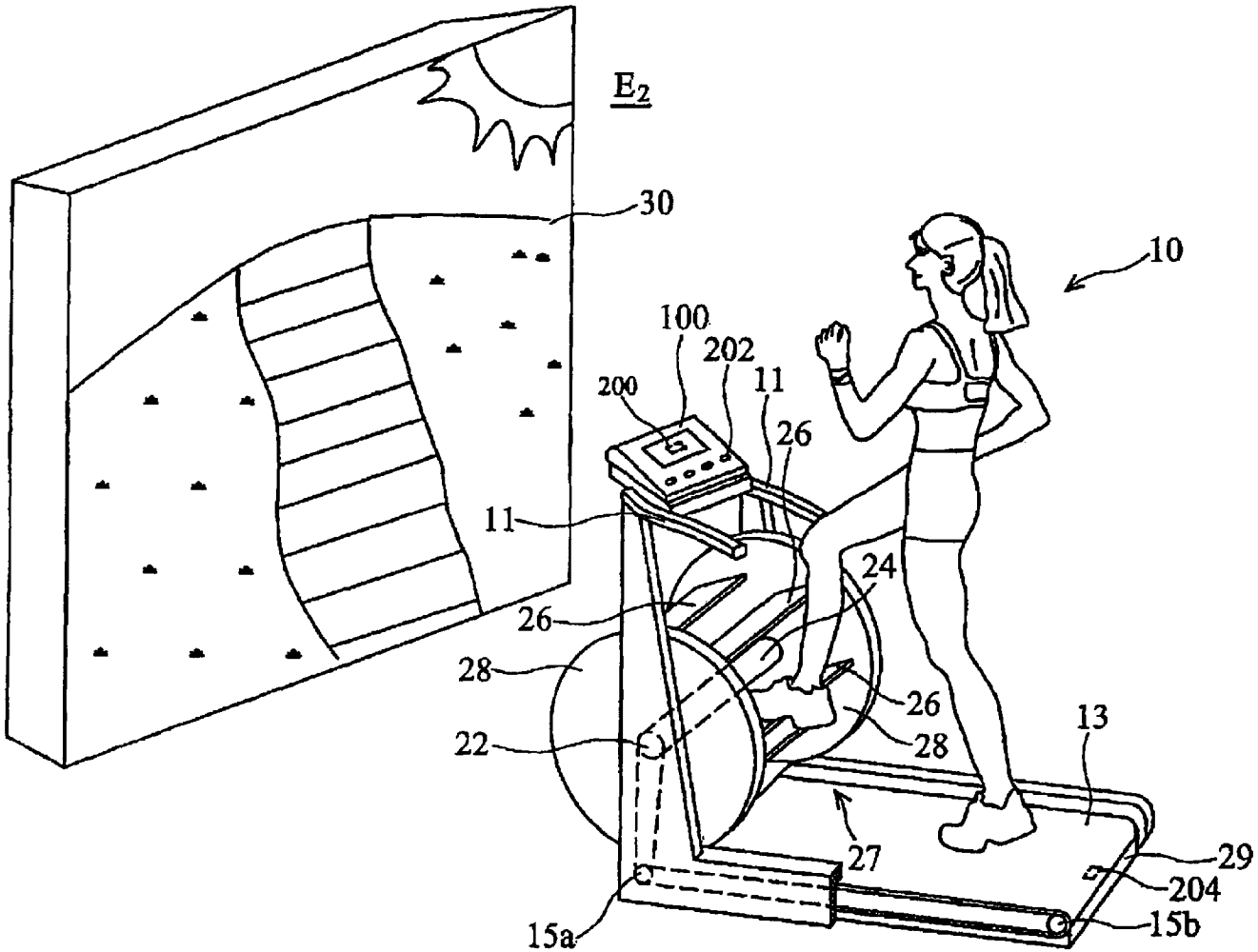
FIG. 3A is a schematic view of an exercise device with panel-type display device according to the first embodiment of the present invention.

FIG. 3A is a schematic view of an exercise device $E_2$ with a panel-type display device according to the first embodiment of the invention. Here, a simulated environment is shown on the display 30 in front of the panel 100 and coupled to the panel 100, such that the user 10 can choose the content thereof.

Figure 3B:
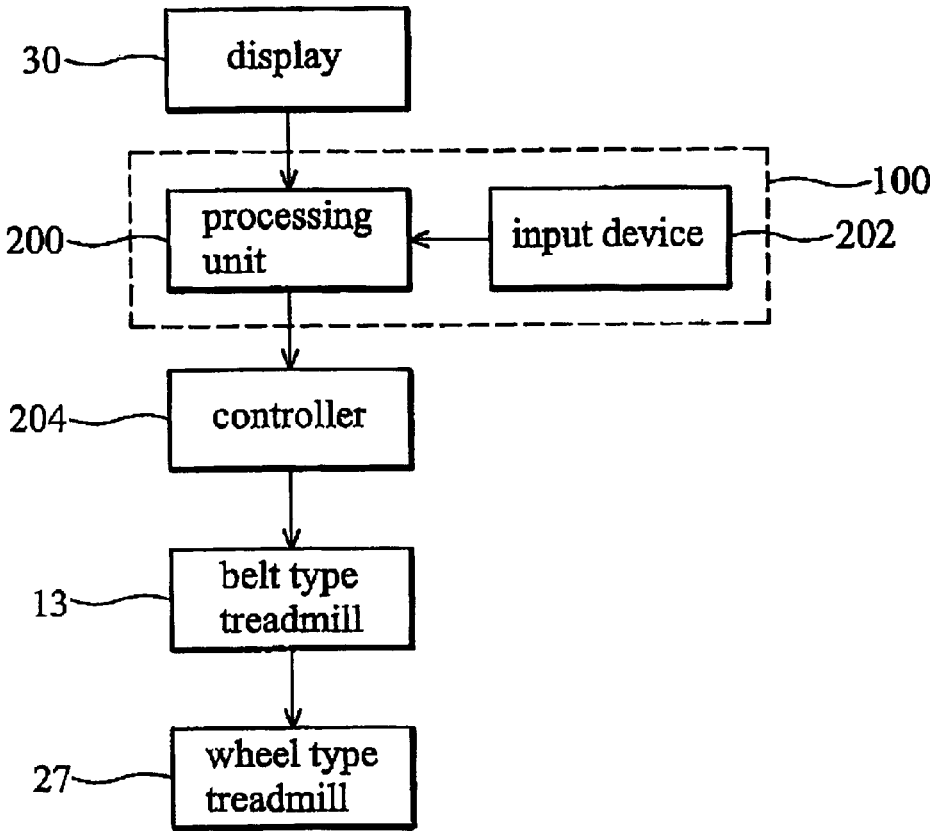
FIG. 3B is a flowchart showing steps for operating an exercise device and display device according to the first embodiment of the invention.

FIG. 3B is a flowchart showing steps for operating the exercise device $E_2$ with display. In this case, the display 30 is also coupled with the panel 100. The panel 100 has a processing unit 200 and input device 202. When the processing unit 200 receives a command from the input device 202, a signal is sent to a controller 204 located at the base 29. The controller 204 controls the belt type treadmill 13. The belt type treadmill 13 is coupled to the wheel type treadmill 27 by the transmission mechanism 22. Thus, combining the belt type and the wheel type treadmill provides a variety of exercise types.

Figure 4A:
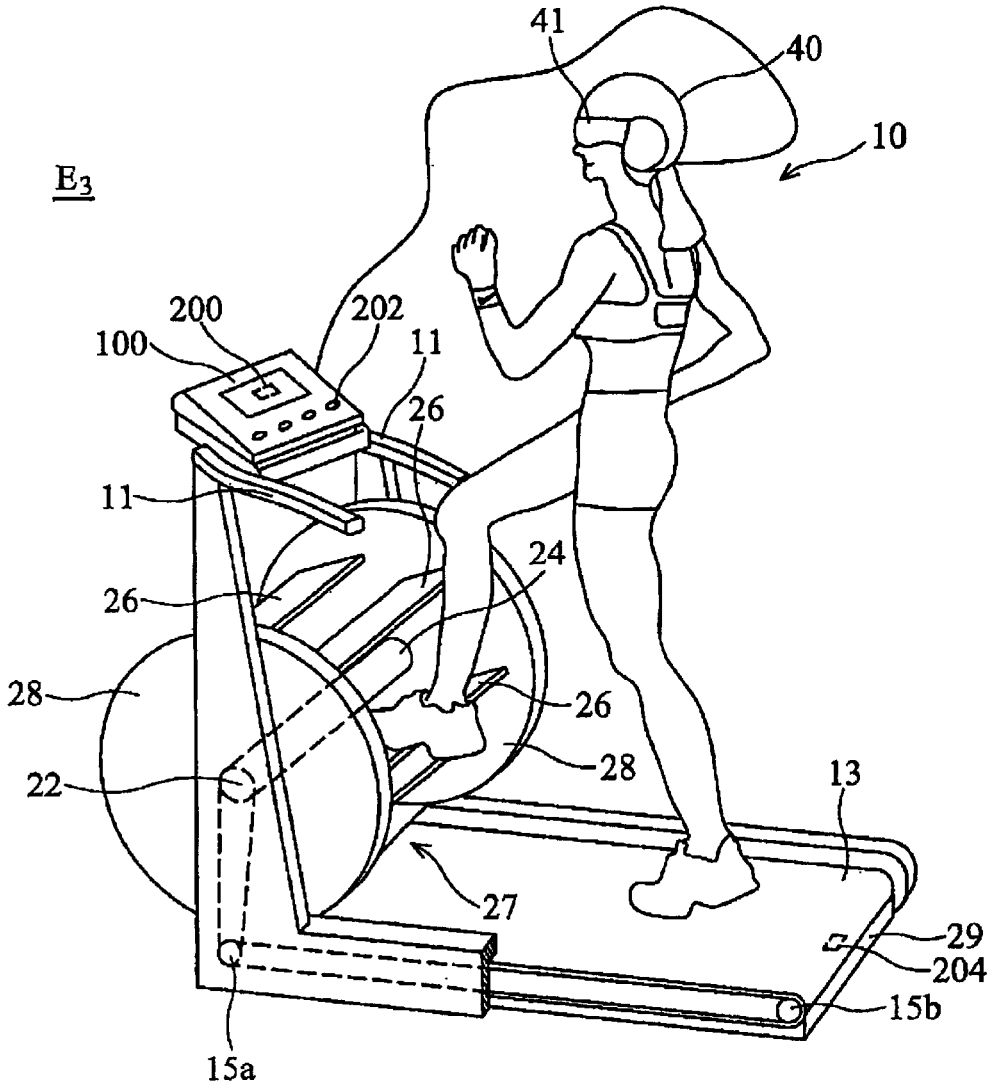
FIG. 4A is a schematic view showing the exercise device with personal display device according to the second embodiment of the invention.
Figure 4B:
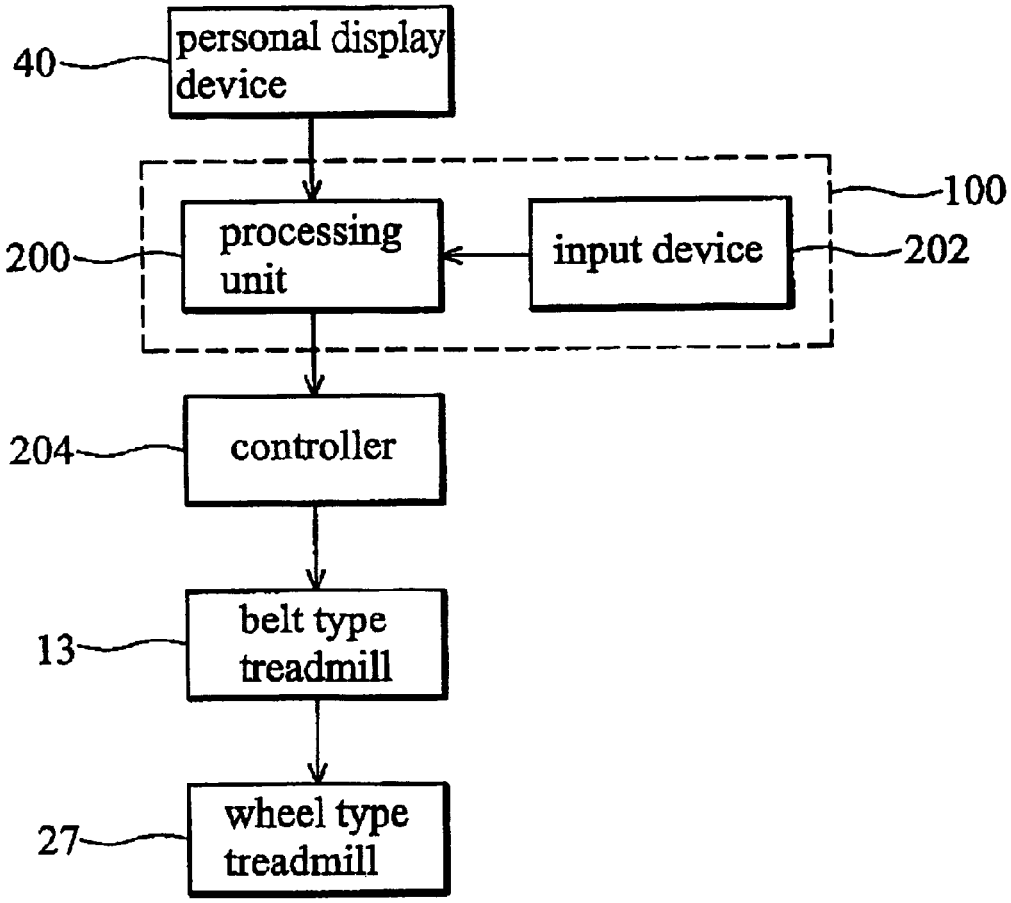
FIG. 4B is a flowchart showing steps for operating an exercise device and personal display device according to the second embodiment of the invention.

FIG. 4 is a schematic view showing the exercise device $E_3$ equipped with a personal display device 40 according to the second embodiment of the invention. The personal display device 40 can be a helmet with a display unit 41 therein for user to view the simulated videos. The personal display device 40 may be a wireless helmet. When the user 10 is running on the compound treadmill with the personal display device 40 thereon, the speed of the video is changed by the level of activity on the exercise device. That is, the running speed can control the speed of what is been viewed. Thus, users can enjoy exercise while watching different videos as running, walking or climbing in a simulated environment.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An exercise device, comprising:

a belt type treadmill and attached to the frame;

a wheel type treadmill, disposed adjacent to the belt type treadmill, including a plurality of steps coupled between two wheels, with a transmission shaft coupled to the wheels;

a transmission mechanism having a first roller shaft and a second roller shaft, coupled to the transmission shaft, wherein the first and second roller shafts drive the belt type treadmill; and a panel, coupled to the belt type treadmill, providing different operation settings of the exercise device whereby a user steps directly upon said treadmill belt and/or treadmill steps during exercise.

2. The exercise device as claimed in claim 1, further comprising a display unit, coupled to the panel, providing an environmental simulation.

3. The exercise device as claimed in claim 2, further comprising a personal display device, with the display unit disposed therein, coupled to the panel.

4. The exercise device as claimed in claim 2, the panel further comprising a processing unit and an input device, coupled to the belt type treadmill and the display unit, wherein the processing unit receives a command from the input device, thereby controlling the belt type treadmill.

5. The exercise device as claimed in claim 4, further comprising a controller, coupled to the processing unit and the belt type treadmill, wherein a signal is delivered from the input device to the controller to control the belt type treadmill.

6. An exercise device, comprising: a frame; a belt type treadmill, having an endless belt, attached to the frame;

a wheel type treadmill, disposed adjacent to the belt type, treadmill and attached to the frame, including a plurality of steps coupled between two wheels, with a transmission shaft coupled to the wheels;

a transmission mechanism having a first roller shaft and a second roller shaft, coupled to the transmission shaft, wherein the first and second roller shafts drive the belt type treadmill;

a panel, coupled to the belt type treadmill,providing different operation settings of the exercise device; and a display, coupled to the panel, providing environmental simulation whereby a user steps directly upon said treadmill belt and/or treadmill steps during exercise.

7. The exercise device as claimed in claim 6, the panel further comprising a processing unit and an input device, coupled to the belt type treadmill and the display, wherein the processing unit receives a command from the input device, thereby controlling the belt type treadmill and the display simultaneously.

8. The exercise device as claimed in claim 7, further comprising a controller, coupled to the processing unit and the belt type treadmill, wherein a signal is delivered from the input device to the controller to control the belt type treadmill and the display.

9. An exercise device, comprising:

a frame; a belt type treadmill, having an endless belt, attached to the frame;

a wheel type treadmill, disposed adjacent to the belt type treadmill and attached to the frame, including a plurality of steps coupled between two wheels, with a transmission shaft coupled to the wheels;

a transmission mechanism having a first roller shaft and a second roller shaft, coupled to the transmission shaft, wherein the first and second roller shafts drive the belt type treadmill;

a panel, coupled to the belt type treadmill, providing different operation settings of the exercise device; and a personal display device, having a display unit disposed therein, coupled to the panel whereby a user steps directly upon said treadmill belt and/or treadmill steps during exercise.

10. The exercise device as claimed in claim 9, the panel further comprising a processing unit and an input device, coupled to the belt type treadmill and the personal display device, wherein the processing unit receives a command from the input device, thereby controlling the belt type treadmill and the personal display device simultaneously.

11. The exercise device as claimed in claim 10, further comprising a controller, coupled to the processing unit and the belt type treadmill, wherein a signal is delivered from the input device to the controller to control the belt type treadmill and the personal display device.

* * * * *